US006217626B1

(12) United States Patent
Morris et al.

(10) Patent No.: US 6,217,626 B1
(45) **Date of Patent: *Apr. 17, 2001**

(54) HIGH PRESSURE STORAGE AND TRANSPORT OF NATURAL GAS CONTAINING ADDED $C_2$ OR $C_3$, OR AMMONIA, HYDROGEN FLUORIDE OR CARBON MONOXIDE

(75) Inventors: Ian Morris, Campbell River; Glen Perry, Calgary, both of (CA)

(73) Assignee: JL Energy Transportation Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 08/895,582

(22) Filed: Jul. 16, 1997

Related U.S. Application Data

(63) Continuation-in-part of application No. PCT/CA96/00750, filed on Nov. 18, 1996, which is a continuation-in-part of application No. 08/560,402, filed on Nov. 17, 1995, now abandoned.

(30) Foreign Application Priority Data

May 16, 1997 (CA) ..... 2205685

(51) Int. Cl.[7] ..... C07C 7/20; F17D 1/04

(52) U.S. Cl. ..... 48/190; 585/899

(58) Field of Search ..... 48/190, 197; 137/3, 137/13; 62/600; 585/1, 6, 14; 535/399

(56) References Cited

U.S. PATENT DOCUMENTS

| | | | | |
|---|---|---|---|---|
| 2,550,844 | * | 5/1951 | Meiller et al. | 48/190 |
| 2,958,205 | | 11/1960 | McConkey . | |
| 3,071,452 | | 1/1963 | Braconier et al. . | |
| 3,232,725 | * | 2/1966 | Secord et al. | 48/190 |
| 3,298,805 | | 1/1967 | Second et al. . | |
| 3,407,613 | | 10/1968 | Muller et al. . | |
| 3,574,276 | | 4/1971 | Strelzoff . | |
| 4,139,019 | | 2/1979 | Bresie et al. . | |
| 4,958,653 | | 9/1990 | Lowther . | |
| 5,020,561 | | 6/1991 | Li . | |
| 5,230,938 | | 7/1993 | Hess et al. . | |
| 5,315,054 | | 5/1994 | Teel . | |

FOREIGN PATENT DOCUMENTS 1415729 11/1975 (GB) .

OTHER PUBLICATIONS

Engineering Data Book, 10th Edition, vol. 1, Sections 13, 17, & 23, Gas Processors Association (1987).

(List continued on next page.)

*Primary Examiner*—Shrive Beck
*Assistant Examiner*—Frederick Varcoe
(74) *Attorney, Agent, or Firm*—George E. Fisk; Blake, Cassels & Graydon LLP

(57) ABSTRACT

For storage of natural gas at pressures over 1,000 psia, it is advantageous to add to natural gas an additive which is a $C_2$ or $C_3$ hydrocarbon compound, or a mixture of such hydrocarbon compounds. Above a lower limit (which varies with the additive being added and the pressure), there is a decrease in the amount of power needed to compress the mixture. For storage or pipeline transportation of natural gas at pressures over 800 psia, it is advantageous to add ammonia to the natural gas, in an amount such that the ammonia does not create a liquid phase at the temperature and pressure used. The ammonia-natural gas mixture can be compressed or pumped with a lower energy expenditure than would be needed for an equivalent volume of natural gas alone. When more than 4% by volume of ammonia is present, the pumping through pipelines is also aided by the refrigerant effect of the ammonia, which reduces the temperature of the gas being transported. Instead of ammonia, hydrogen fluoride or carbon monoxide can be added to the natural gas, but these are less preferred than ammonia.

17 Claims, 6 Drawing Sheets

OTHER PUBLICATIONS

Peng, D. & Robinson, D.B, "A New Tow–Constant Equation of State", Ind. Eng. Chem. Fundamentals (1976) p. 59.

Van Velzen, P., Carbozo, R.L., & Langenkamp, H. "A Liquid Viscosity–Temperature–Chemical Constitution Relation for Organic Compounds" Ind. Eng. Chem. Fundamentals (1972) p. 20.

Dean, D. E., & Stiel, L.I. "The Viscosity of Non Polar Gas Mixtures at Moderate & High Pressures", Aiche Journal, (May 1965) p. 526.

Eaton, B.A., Andrews, D.E, Knowles, C.R, Silberberg, I.K., & Brown, K.E. The Prediction of Flow Patterns, Liquid Hold–up and Pressure Losses Occurring During Continuous Two–Phase Flow in the Horizontal Pipelines, Journal of Petrol Tech. (Jun. 1967) p. 815

Taitel, Y. & Dukler, A "A Model for Predicting Flow Regime Transitions in Horizontal & Near Horizontal Gas–Liquid Flow", Aiche Journal (Jan. 1976) p. 47.

Oliemans, R. U. A. "Two Phase Flow–in Gas–Transmission Pipelines " Paper, Joint Petroleum Mech. Eng. & Pressure Vessels & Piping Conf., Mexico City, Mexico (Sep. 1976) p. 1

Connell, D. E. Horth, P and Powell, R. H. W. "Analysis Sets Optimum $C_3$ Recovery for North Sea Gas Terminal" Oil & Gas Journal, Oct. 4, 1993 p. 74.

Stripling, T. E., Khan, A. U. and Dillon, K. "Hydraulic Analysis Aids High Pressure System Design Technology", Jan. 28, 1985, Oil & Gas Journal p. 125.

King, G. "Ultra–High Gas Pressure Pipelines Offer Advantages for Artic Service" Oil & Gas Journal Jun. 1, 1992 p. 79.

Author Unknown, "What Mobil Has Learned in Phase B At. St. Fergus " Oil & Gas Journal, Sep. 5, 1994 p. 100.

* cited by examiner

HIGH PRESSURE STORAGE AND TRANSPORT OF NATURAL GAS CONTAINING ADDED $C_2$ OR $C_3$, OR AMMONIA, HYDROGEN FLUORIDE OR CARBON MONOXIDE

CONTINUING APPLICATION DATA

This application is a continuation-in-part of international application PCT/CA96/00750, filed Nov. 18, 1996 (which designates the United States of America), which is in turn a continuation-in-part of U.S. application 08/560,402, filed Nov. 17, 1995 now abandoned, Convention priority for the subject matter of this application not contained in International Application PCT/CA96/00750 is claimed on the basis of Canadian Patent Application 2,205,678, filed May 16, 1997, now Canadian Patent 2,205,678.

FIELD OF THE INVENTION

This invention relates to the transfer by pipeline or storage of mixtures which contain methane or natural gas.

BACKGROUND OF THE INVENTION

As is well known, methane is the largest component of natural gas, and usually accounts for at least 95% by volume of what is known as "transmission specification" natural gas. Other usual components are ethane (usually about 2%), propane (usually about 0.5%), butanes, pentanes and possibly hexanes (altogether amounting to less than about 0.3%), with the balance being nitrogen and carbon dioxide. In this disclosure, transmission specification natural gas will be hereinafter called "natural gas". For example, the natural gas as transmitted through the pipelines of TransCanada Pipeline Limited from Alberta, Canada to Ontario, Canada has typically the following percentage composition by volume:

| Component | Feed |
|---|---|
| Nitrogen | 0.01270 |
| Carbon Dioxide | 0.00550 |
| Methane | 0.95400 |
| Ethane | 0.01970 |
| Propane | 0.00510 |
| i-Butane | 0.00170 |
| n-Butane | 0.00080 |
| i-Pentane | 0.00020 |
| n-Pentane | 0.00010 |
| n-Hexane | 0.00020 |

The relation between pressure, volume and temperature of a gas can be expressed by the Ideal Gas Law, which is stated as PV=nRT, where:

P=pressure of gas

V=volume of gas n=number of moles of the gas

R=the universal gas constant (which, as is known, varies somewhat depending on volume and temperature)

T=temperature of the gas.

If the equation is expressed in English units, the pressure is in pounds per square inch absolute (psia), the volume is in cubic feet, and temperature is in degrees R (degrees Fahrenheit plus 460).

The Ideal Gas Equation does not give exactly correct results in actual practice, because gases are compressible. Gas molecules, when compressed, pack more tightly together than would be predicted by the Ideal Gas Equation, because of intermolecular forces and molecular shape. To correct for this, an added term, the compressibility factor z, can be added to the Ideal Gas Equation. This is a dimensionless factor which reflects the compressibility of the particular gas being measured, at the particular temperature and pressure conditions.

At atmospheric pressure or gage pressures of a few hundred pounds, the compressibility factor is sufficiently close to 1.0 so that it can be ignored for most gases, and so that the Ideal Gas Law can be used without the added term z. However, where pressures of more than a few hundred pounds exist, the z term can be different enough from 1.0 so that it must be included in order for the Ideal Gas Equation to give correct results.

According to the van der Waals theorem, the deviation of a natural gas from the Ideal Gas Law depends on how far the gas is from its critical temperature and critical pressure. Thus, the terms $T_R$ and $P_R$ (known as reduced temperature and reduced pressure respectively) have been defined, where $$T_R = \frac{T}{T_c}$$

$$P_R = \frac{P}{P_c}$$

where,

T=the temperature of the gas in degrees R $T_c$=the critical temperature of the gas in degrees R P=the pressure of the gas in psia $P_c$=the critical pressure of the gas in psia Critical pressures and critical temperatures for pure gases have been calculated, and are available in most handbooks. Where a mixture of gases of known composition is available, a pseudo critical temperature and pseudo critical pressure which apply to the mixture can be obtained by using the averages of the critical temperatures and critical pressures of the pure gases in the mixture, weighted according the percentage of each pure gas present.

Once a pseudo reduced temperature and pseudo reduced pressure are known, the compressibility factor z can be found by use of standard charts. One of these is "Compressibility Factors for Natural Gases" by M. D. Standing and D. L. Katz, published in the *Engineering Data Book*, Gas Processors Suppliers Association, 10th edition (Tulsa, Okla. U.S.A.) 1987.

When the compressibility factor z of methane is read from the charts, it is found that the factor z is always less than 1.0 in normal temperature ranges (i.e. between about −40° F. and 120° F.) and that it decreases as the pressure rises or the temperature falls. Therefore, less energy need be used to pump a given volume of methane (measured at standard volume) at any given normal temperature than would be expected at that temperature if the methane were an ideal gas. This effect is more marked at higher pressures. Similarly, as the pressure is increased at a constant temperature, more methane (measured at standard volume) can be stored in a given volume than would be predicted from the Ideal Gas Equation. "Standard volume" is volume measured at standard pressure and temperature (STP)).

Natural gas, like methane, shows z factor changes with pressure. Under about 1000 psia the dominant variable in the power relationship is the molecular weight of the gas. At this pressure level, addition of further amounts of ethane or propane increases the molecular weight of the gas more rapidly than the z factor decreases. Thus, there is an advantage to removing ethane and propane from the gas.

It is usual in the gas transportation and storage industry to try to strip out higher hydrocarbons such as ethane, propane, butane and unsaturated hydrocarbons from natural gas if the gas is to be transmitted through pipelines. This leaves mostly methane (with some traces of nitrogen and carbon dioxide) to be transported by the gas pipeline. The materials which are stripped out are then transported or stored separately, often as liquids.

SUMMARY OF THE INVENTION

It has now been found that, for natural gas storage at pressures over 1,000 psia, it is advantageous to add to the natural gas an additive which is a $C_2$ or $C_3$ hydrocarbon compound, , carbon monoxide, hydrogen fluoride or a mixture of such additives, or such additives with ammonia. Ammonia without other additives is useful as an additive for gas storage at pressures down to about 800 psia. Above a lower limit (which varies with the additive being added and the pressure), this results in a smaller $zM_w$ product, and therefore a decrease in the amount of power needed to compress the mixture for storage and to keep it compressed. It is also advantageous to add ammonia to natural gas to be transmitted through pipelines at pressures above 800 psia. Depending on the economics, it also can be advantageous to add carbon monoxide and/or hydrogen fluoride. The precise amount of each additive which can be added at any pressure for beneficial results can be found by calculating the product of the molecular weight ($M_w$) times the z factor of the resulting mixture, and comparing it with the product of the molecular weight times the z factor of the original natural gas. If the product ($zM_w$) is smaller for the mixture than for the natural gas, a saving of energy can be obtained in pumping and compression.

DETAILED DESCRIPTION OF THE INVENTION

If ethane is the additive, enough ethane must be added to methane or natural gas to give a gas composition having a minimum of about 26% ethane for operation at 1,000 psia and normal temperatures (−40° F. to +110° F.). (All percentages in this document are percentages by volume). Ethane can be added until just before the mixture separates into separate gas and liquid (which occurs at about 40% ethane for a pressure 1,000 psia and a temperature of about 35° F.). To reduce the danger of liquefaction if there is inadvertent pressure drop, and to reduce temperature extremes, generally operation at 26–35% ethane and 35° F. to +40° F. is preferred.

When the pressure is raised to 2,200 psia, the addition of enough ethane to natural gas to give a gas composition having more than 6% ethane gives some beneficial results. Thus, as pressure increases, in the range from 1,000 psia to about 2,200 psia the beneficial results occur with less and less ethane. For the most beneficial results, however, an addition of enough ethane to give at least 15% ethane is preferred at pressures of 2,200 psia.

Thus, for ethane as an additive, an amount is added to give a gas which has at least 26% ethane (but preferably 35% ethane) at 1,000 psia, and at least 6% ethane (but preferably 15% ethane) at 2,200 psia, with the minimum percentage of ethane decreasing smoothly with rise in pressure. Ethylene may be substituted for all or part of the ethane on a 1:1 volume basis. Where pressure fluctuates, as in a gas pipeline where the gas is compressed at compressor stations and becomes less compressed as it flows between compressor stations, the pressure indicated is the maximum pressure to which the gas is compressed. In such a compression-rarefaction arrangement, it is preferred that the ratio between the most compressed and the most rarefied pressures of the gas not exceed 1.3:1.

$C_3$ hydrocarbons alone can also be used as the additive. Minimum useable percentage of the total gas mixture vary from a minimum of 5% at 1,000 psia to about 3% at 2,200 psia. Maximum amounts are those which will not cause separation of a liquid phase at the temperature used. The $C_3$ hydrocarbons may be any of propane, isopropane or propylene, separately or in admixture.

One or more $C_3$ hydrocarbons may also be substituted, preferably on a 1:3.5 volume basis, for $C_2$ hydrocarbons, but not to a point where they cause separation of a liquid phase at the pressure and temperature of operation. (A 1:3.5 basis means that each standard volume of $C_3$ hydrocarbon replaces three and a half standard volumes of $C_2$ hydrocarbon.) Generally, the limitation that a liquid phase should not be formed means that not more than about 12% of $C_3$ hydrocarbons should be present at 1000 psia and 60° F., and lesser amounts should be used as the pressure or temperature increases.

Two or more of the $C_2$ or $C_3$ additives can also be used. The use of two or more additives has a synergistic effect in many cases, so that less than the minimum amount of each is needed than would be needed if only one were present, in order to produce a $zM_w$ product smaller than that of an equivalent standard volume of natural gas at the pressure and temperature involved.

At pressures over 1000 psig, $C_4$ hydrocarbons do not contribute much to the improvement of the $zM_w$ product. Thus $C_4$ hydrocarbons are not additives contemplated by this invention. However $C_4$ hydrocarbons which are already present in the natural gas need not be removed if they are present in insufficient quantity to liquify or to affect the $zM_w$ product very adversely. The presence of more than 1% $C_4$ hydrocarbon in the mixture is not preferred, however, as $C_4$ hydrocarbons tend to liquify easily at pressures between 1,000 psia and 2,200 psia, and more than 1% $C_4$ hydrocarbons give rise to increased danger that a liquid phase will separate out. $C_4$ hydrocarbons also have an unfavourable effect on the mixture's z factor at pressures just under 900 psia, so care should be taken that, during transport through a pipeline, that mixtures according to the invention which contain $C_4$ hydrocarbons are not allowed to decompress to less than 900 psia, and preferably not to less than 1,000 psia.

The addition of amounts of additive below the lower limit (unless two additives with a synergistic effect are used) actually increase the $zM_w$ product over that of methane or natural gas alone, and is thus detrimental. For example, when the pressure is 1,000 psia and the temperature is 35° F., mixtures of methane and ethane having less than about 26% ethane have a z factor greater than methane alone (all percentages are based on volumes at standard pressures and temperatures). Adding ethane to increase the percentage of ethane from 2% to, for example 12% at this pressure and temperature is therefore counterproductive, as it increases the $zM_w$ product and therefore increases the energy required to pump or compress for storage a given standard volume of gas. However, when more than 26% of ethane is present, the z factor falls so much that the $zM_w$ product tends to lower values than that of pure methane. The z factor continues to get smaller with increased percentages of ethane, bringing with it a lower $zM_w$ product to the point where further increase of ethane causes separation of a liquid phase (at about 40% ethane at 1,000 psia and 35° F.). Thus, adding ethane to natural gas so that there is a mixture containing more than 26% ethane at 1,000 psia and 35° F. leads to increased packing of molecules and a decreased $zM_w$ product, hence decreased pumping costs and more ability to store within a given volume. At 1,350 psia and 85° F., improved results over methane alone are obtained when only 17% of ethane is present in the mixture. Where the pressure is increased to 1,675 psia at 35° F., mixtures with 13% or more ethane, and the balance methane give improved results over methane alone. At 2,140 psia and 35° F., the improved effect is shown in mixtures of 6% ethane and the balance methane.

By the avoidance of liquid phase in this disclosure is meant the avoidance of enough liquid to provide a coherent liquid phase in the pipeline or storage facility at the temperatures and pressures used. In a pipeline situation, such a phase can create pipeline problems through pooling in low portions of the pipeline or forming liquid slugs which affect pumping efficiency. A few liquid droplets in the line however, can be tolerated.

$C_4$ hydrocarbons (eg butanes and butylenes) and other components of the natural gas need not be separated out before storing gases according to this invention. Of course, it may be desired to separate out corrosive materials so that they will not damage the compressors.

Ammonia can also be used as the additive, either in substitution for or in admixture with the hydrocarbon additives. Approximately 10–12 % by volume NH3 causes separation of a liquid phase, depending on the pressure and temperature, so the amount added should be below the amount which causes separation of a liquid phase. Any amount of ammonia gives some benefit at the pressures of this invention, but a minimum of 0.5% is preferred in order to get appreciable advantages. Ammonia gives a beneficial effect at even a lower pressure than the other additives, and can be added when storage will take place at any pressure above 800 psia.

Carbon monoxide does not have enough economic or heating value to warrant passing it through a pipeline in most cases, even if it reduces the overall energy needed to pump the mixture of itself and natural gas, Similarly, carbon monoxide usually does not have enough economic value to warrant storing it, even when the decrease in $zM_w$ product causes the mixture of carbon monoxide and natural gas to be stored with lower energy expenditure than natural gas alone.

Hydrogen fluoride exhibits a cooling effect analogous to that of ammonia, so that in principle, hydrogen fluoride is also a particular advantageous additive. However, hydrogen fluoride, although it is valuable, is also a highly poisonous and corrosive agent, and its storage and handling need special lines and valves. Usually, the cost of such special lines and valves, and the risks of storing or transporting a highly dangerous product, outweigh any advantage in reduced pumping or compression costs or even refrigeration arising from the mixing of hydrogen fluoride with natural gas in most circumstances. Also, a large supply of hydrogen fluoride is not typically available where natural gas is found. Thus, usually hydrogen fluoride is not as preferred as ammonia in the practice of this invention, although it could be economically useable where sufficient supplies occur with natural gas, and where markets for hydrogen fluoride occur near the downstream end of the pipeline.

Two or more of these additives can be used together. The use of two or more additives has a synergistic effect in many cases, so that less than the minimum amount of each is needed than would be needed if only one were present, in order to produce the z factor over that of an equivalent standard volume of natural gas at the pressure and temperature involved.

In this disclosure gas "storage" includes the holding of gas in a tank or subterranean cavern or the like, and also the holding of gas in an endless loop of pipeline. All of these types of storage are collectively referred to as a "storage chamber".

Hydrocarbon additives are particularly advantageous for storage as they permit storage of a mixture of methane or natural gas and the hydrocarbon additive in the same storage chamber with less energy expenditure than if the two were stored separately.

Ammonia is also a useful additive, as it can be made easily and cheaply from waste hydrogen or natural gas. Thus, a ready supply of ammonia can be made available wherever there is natural gas to store for transport.

The addition of any amount of ammonia to natural gas decreases the $zM_w$ product significantly from that of natural gas alone at pressures over 800 psia and at temperatures from −40° F. to +110° F. Depending on the pressure and temperature, up to about 10–12% ammonia can be added before the mixture begins to separate out into separate liquid and gas phases. Increasing the percentage by volume of ammonia, right up until a liquid phase separates, steadily increases the benefit obtained. Thus, there is an advantage to adding ammonia to natural gas which is to be compressed and stored (as in a tanker or storage tank), as less energy is needed for compression than would be needed for an equivalent standard volume of methane or natural gas alone. However, the economics of whether it is worthwhile to add ammonia for storage may vary, depending upon the costs of making the ammonia and separating the natural gas from the ammonia when the two are removed from storage for use.

Where the mixture is to be pumped through a pipeline, however, an unexpected and beneficial further effect of using ammonia occurs. In a pipeline, there are pumping stations at intervals along the pipeline. In each pumping station, the gas is compressed. As the gas moves toward the next pumping station, it gradually loses pressure and expands. The compression during passage through the compressor station heats the gas, and it cools while passing through the pipeline, passing some of its heat to the surrounding soil through the pipeline wall.

Ammonia has the property of being a refrigerant, which absorbs heat as it expands. Thus, when an ammonia/natural gas or ammonia/methane mixture is compressed and then subsequently allowed to flow through a gas pipeline, the ammonia cools the mixture as it expands. To get significant cooling, enough ammonia has to be present so that the cooling effect is relatively large relative to other heat losses and gains within the gas mixture. A minimum of about 4% by volume of ammonia is therefore necessary before the cooling becomes significant. This cooling reduces even further the cost of pumping arising from the effect of ammonia on the z factor. Thus, for pipeline use, more than 4% by volume of ammonia is preferred. At the delivery point for the pipeline, the ammonia can be separated from the natural gas and can be sold, as ammonia is a commercially valuable product.

By adjusting the amount of ammonia added to the gas mixture and by spacing the pumping stations so that a desired temperature drop occurs between stations because of the refrigerant effect of ammonia, the gas mixture can be made to flow through the pipeline at temperatures not exceeding a particular desired temperature. In the case of pipelines flowing through permafrost (as in the Arctic or Antarctica), the line can be designed and the added amount of ammonia adjusted so that the pipeline temperature never exceeds the melting temperature of the permafrost. This makes feasible uninsulated or only slightly insulated pipelines through permafrost, which pipelines do not damage their environment by melting it.

BRIEF DESCRIPTION OF THE DRAWINGS

The invention will be described further in association with the following drawings in which:

FIG. 4A shows the effect of addition of ammonia on gas initially at 1100 psia, while FIG. 4B shows the effect on gas initially at 1900 psia.

DETAILED DESCRIPTION OF THE EMBODIMENTS SHOWN IN THE DRAWINGS

Dealing first with FIG. 1, this shows, for various pressures and the same temperature, the effect of the addition of ethane to methane. In each case, the z factor has been calculated for each percentage of ethane from 0 to 40%. Then, the lowest calculated z factor, has been arbitrarily defined as 0% capacity gain. Each of the other results has been plotted as a percentage capacity gain with reference to the 0% capacity gain in order to prepare acurve. Curves developed in this way are given in FIGS. 1A to 1E, for different pressures, with each curve representing the situation for one pressure. The temperature represented by each curve is 35° F.

Figure 1A:
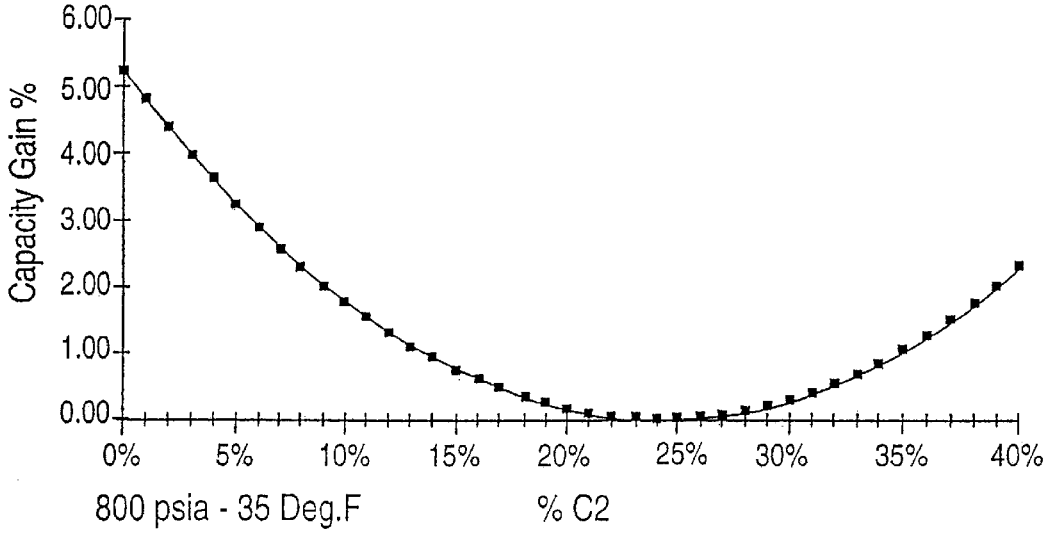
FIGS. 1A to 1E are plots of capacity gain in percent against the content of $C_2$ hydrocarbons in a mixture of methane and ethane. Each of the plots shows the results at a different pressure.

Looking at FIG. 1A, it is seen that, for an 800 psia storage chamber, the best packing occurs when the chamber is filled with pure methane. As ethane is added, the capacity gain percent decreases until there is about 25% ethane in the chamber. After this, the capacity gain begins to increase again, but it does not reach the levels obtained for pure methane.

Figure 1B:
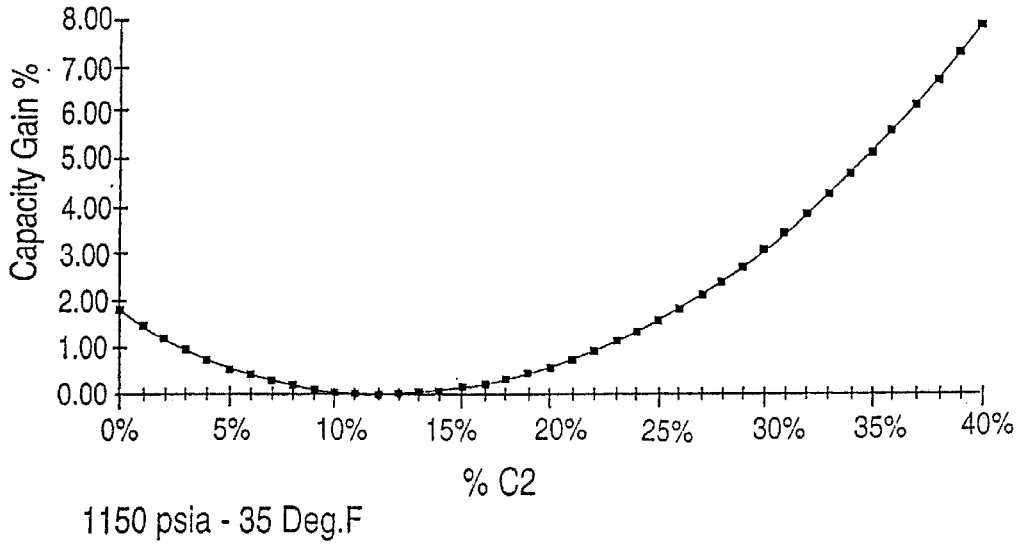

FIG. 1B shows the effect of addition to methane of ethane for a storage chamber at 1,150 psia. Here, the capacity gain steadily decreases from 0% ethane to about 12% ethane, and then increases again. After approximately 25% ethane, the capacity gain is greater than occurred with no ethane at all.

Figure 1C:
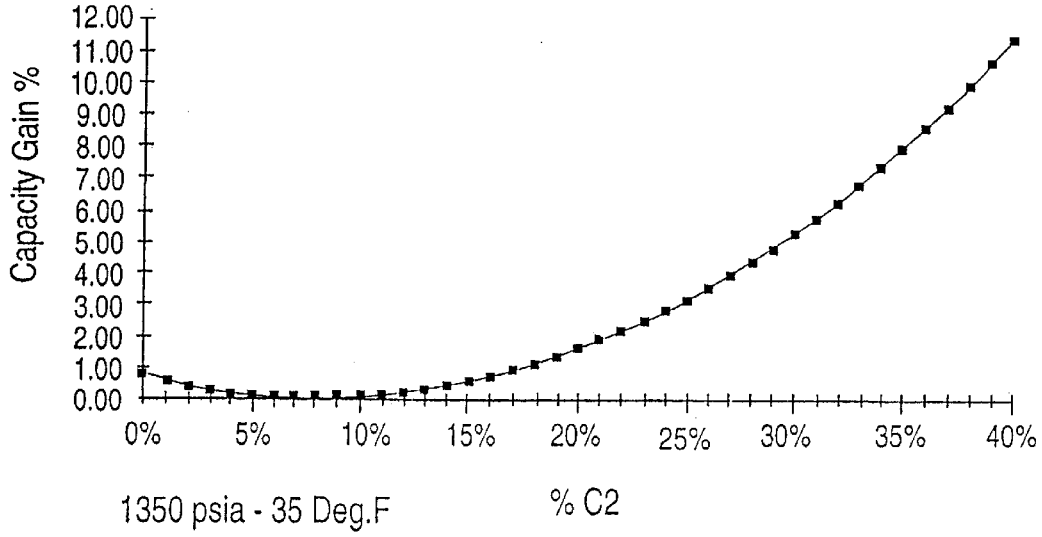

FIG. 1C shows that this effect is even more pronounced when the chamber pressure is increased to 1,350 psia. The lowest capacity now occurs at approximately 7%, and mixtures with more than 17% ethane exhibit packing (and hence, storage capacity) gains unattainable with of natural gas or methane alone.

Figure 1D:
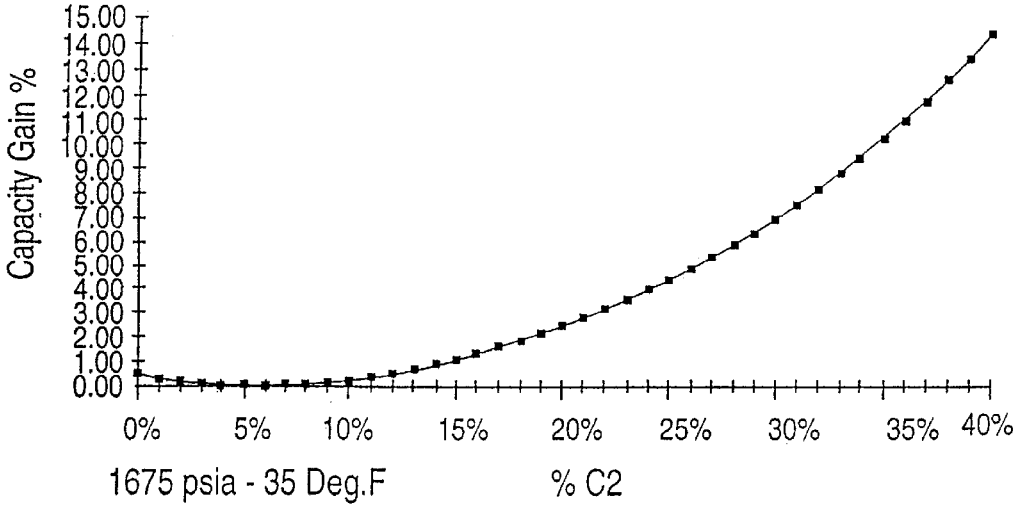
Figure 1E:
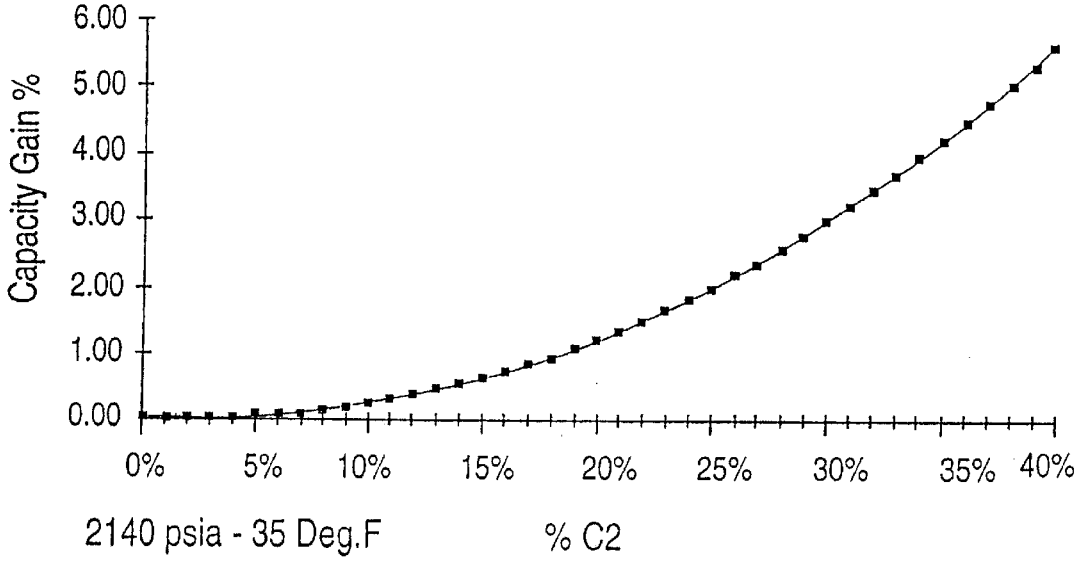

FIG. 1D shows that at 1,760 psia, the lowest capacity occurs at about 5%, and anything over 12% ethane gives a better capacity gain than is attainable with natural gas or methane alone. For best results, however, at least 15% ethane should be present.

At 2,140 psia (FIG. 1E) the addition of about 4% ethane gives a benefit, and the benefit steadily increases all the way up to the point at which the ethane begins to separate out in a liquid phase. For best results, however, at least 12% ethane, and preferably 15% ethane should be present.

Thus, it will be seen that for pressures above about 1,000 psia lower compression cost occurs when increased amounts of ethane are added. At 1,150 psia (FIG. 1B) about 24% ethane must be added to get the same packing effect as the approximately 2% ethane in normal natural gas. If more than this amount is added, however, better packing occurs with each addition. As the pressure increases, successively less ethane need be added to give better packing (and hence lower transmission costs and compression costs) than with natural gas. Indeed, at 2,410 psia, even about 4% ethane shows some advantage, although the advantage is of course greater as more ethane is added.

Figure 2A:
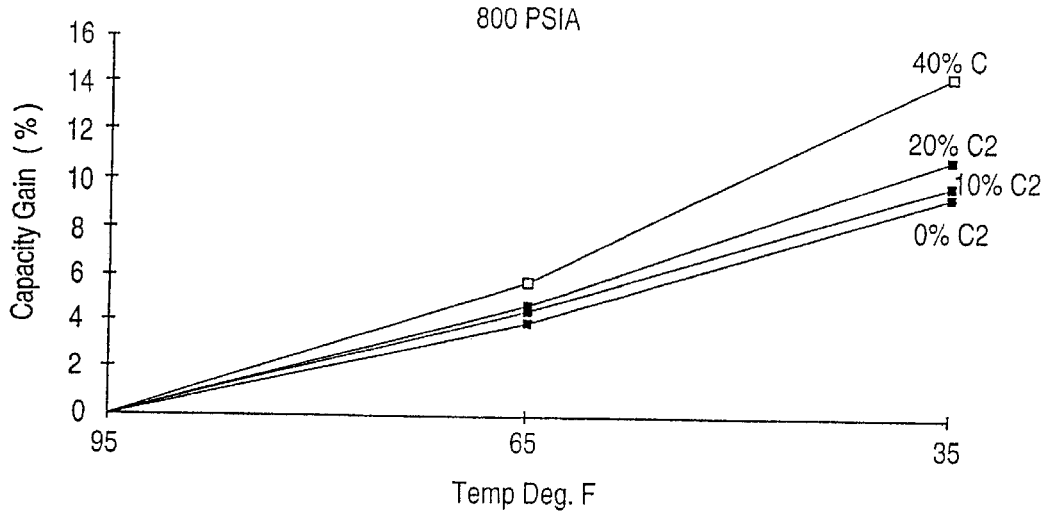
FIGS. 2A and 2B are plots of capacity gain versus temperature (in degrees Fahrenheit) for the same gas mixtures at 800 psia and 1,675 psia respectively.
Figure 2B:
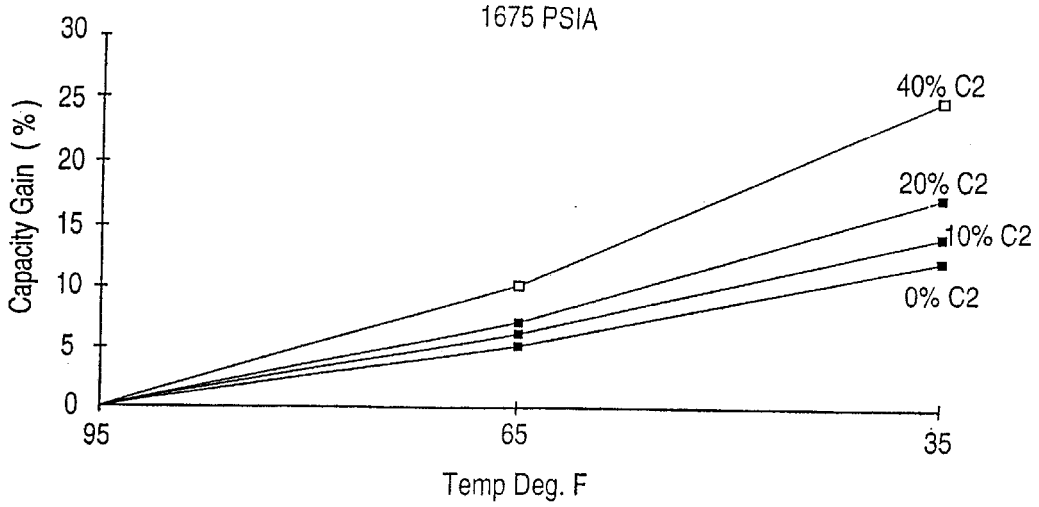

FIG. 2 shows how the effect changes with temperature. Even at 800 psia (FIG. 2A) there is a capacity increase as temperature drops, and the capacity gain is greater the more $C_2$ that is present. With higher pressure (FIG. 2B) the capacity gain is much greater with temperature, and the improvement in capacity gain becomes still greater as increased amounts of ethane are added.

The preferred composition of the gas and preferred conditions for storage when only hydrocarbons is present are the following:

| COMPONENT | MAXIMUM VALUE | MINIMUM VALUE |
|---|---|---|
| METHANE | 92% VOLUME | 68% VOLUME |
| ETHANE AND/Or ETHYLENE | 35% VOLUME | 6% VOLUME |
| PROPANE AND/OR OTHER $C_3$ | 12% VOLUME | 0% VOLUME |
| BUTANES AND OTHER COMPONENTS OF THE NATURAL GAS | Not required, but amount present in original natural gas (up to about 1%) can be tolerated if it does not cause separation of a liquid phase at the pressure and temperature used | 0% VOLUME |
| NITROGEN | Not required, but amount present in the original natural gas can be | 0% VOLUME |

-continued

| COMPONENT | MAXIMUM VALUE | MINIMUM VALUE |
|---|---|---|
| | tolerated if below 2% by volume | |
| CARBON DIOXIDE | Not required, but amount present in the original natural gas can be tolerated if below 1% by volume. | 0% VOLUME |
| COMPONENTS TOTAL 100% | | |
| TEMPERATURE | 120° F. | −20° F. |
| PRESSURE | 2160 PSIA | 1150 PSIA |

Even more preferred pressures are 1350–1750 psia (which gives good results without requiring vessels to withstand higher pressures) and particularly preferred temperatures are 35° F.–120 ° F. (Which do not require undue refrigeration).

Figure 3:
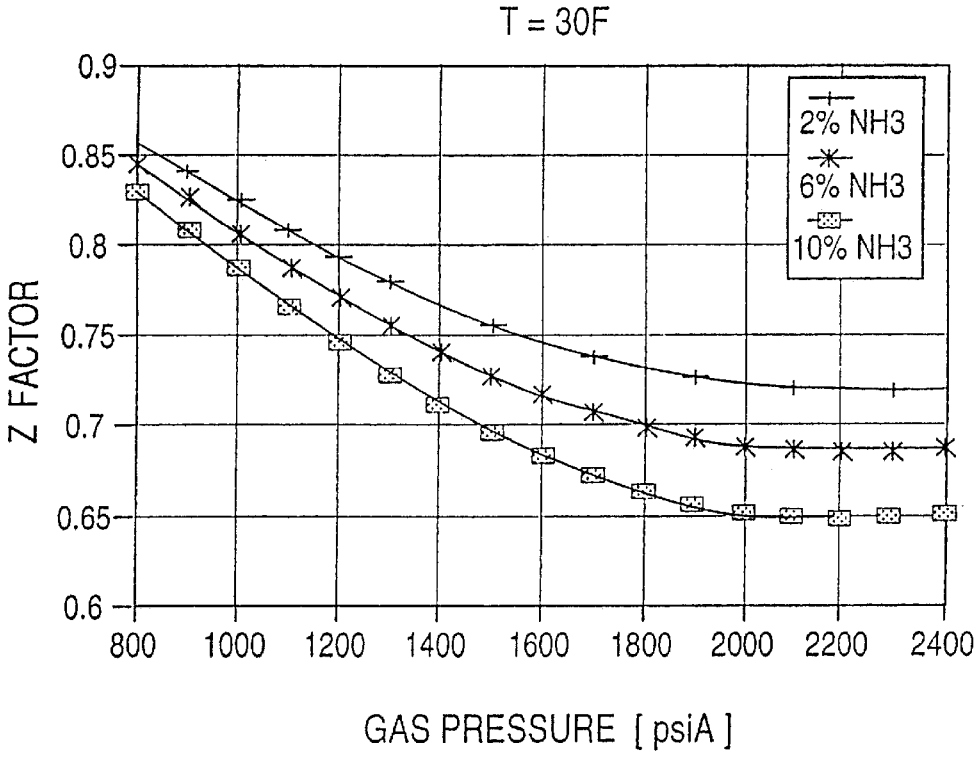
FIG. 3 is a plot of the z factor for a mixture of methane and various concentrations by volume of ammonia, at different pressures and the same temperature.

FIG. 3 shows the effect of 2%, 6% and 10% percentages by volume of ammonia on the z factor, at 30° F. It will be noted that ammonia has a positive effect even at 800 psia, and that increasing percentages of ammonia increase the effect. Increasing pressure also increases the effect, to somewhere between 2000–2200 psia depending on percentage of ammonia, after which further pressure increases do not provide increased benefits.

Figure 4A:
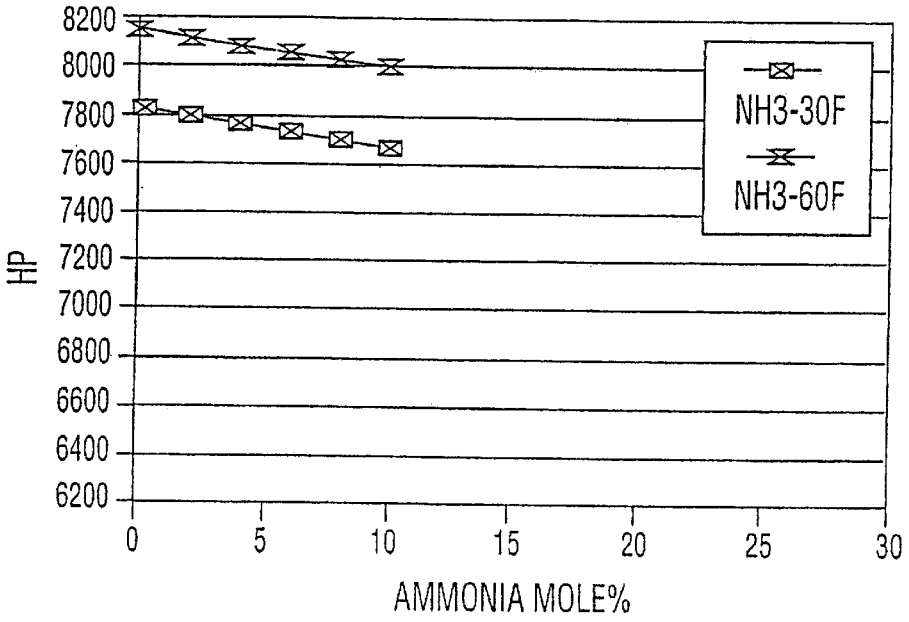
FIGS. 4A and 4B are plots of the horsepower needed to compress natural gas in an idealized pipeline with various amounts of added ammonia.
Figure 4B:
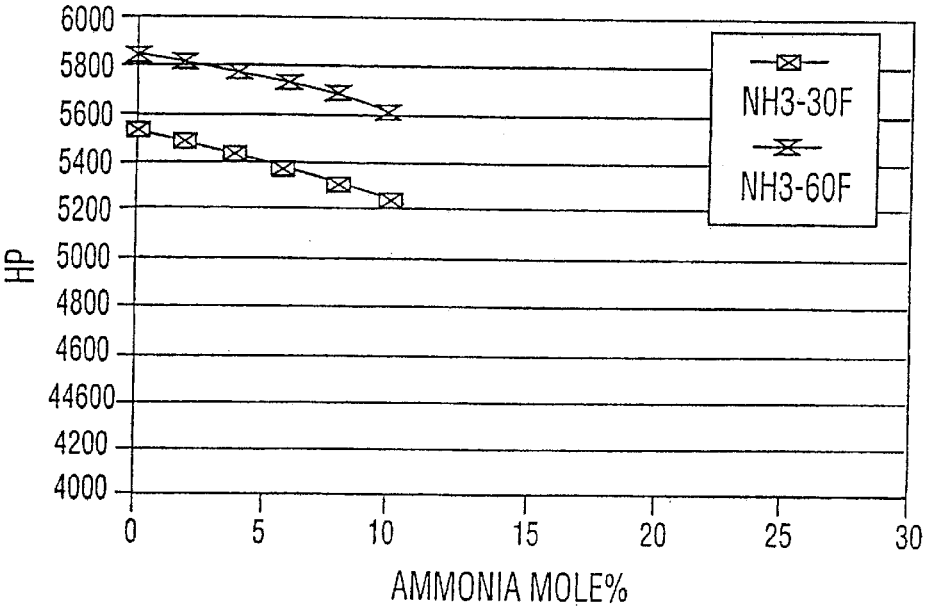

FIG. 4 plots, for temperatures of 30° F. and 60° F., the calculated effect of different amounts of added ammonia to transmission specification natural gas for an idealized 50 mile long pipeline on flat land. The pipeline is assumed to be 36 inches in diameter and to be filled at the input end with gas pressurized to the input pressure. Gas mixtures flow isothermally through the pipeline, and sufficient pumping energy is applied at the input end to give a pressure drop of 150 psia. In FIG. 4A, the gas is initially at 1100 psia, and in FIG. 4B, the gas is initially at 1900 psia.

It will be noted that, in each case, the addition of any amount of ammonia decreases the total horsepower needed for operation of the pipeline at all temperatures and pressures shown. However, when operation is carried out at lower temperature and at higher pressure, the effect is more pronounced. The change in horsepower used is a result of the change in the $zM_w$ product, as other factors are assumed to be constant.

Carbon monoxide and hydrogen fluoride exhibit effects on $zM_w$ similar to those of ammonia. However, as noted previously, these components are not preferred because of the low value of carbon monoxide and the corrosiveness of hydrogen fluoride. If hydrogen fluoride is used, the minimum which should be present is 0.5% by volume for benefits to be obtained. If carbon monoxide is used, the minimum which should be present is 1% by volume. The pressure of storage or pipeline transmission is preferably greater than about 1000 psia, and the temperature is from about −40° F. To about 100° F.

The foregoing has illustrated certain specific embodiments of the invention, but other embodiments will of course be evident to those skilled in the art. Therefore it is intended that the scope of the invention not be limited by the embodiments described, but rather by the scope of the appended claims.

We claim as our invention:

1. A method of storing natural gas, which comprises (a) admixing the natural gas with one or more hydrocarbons selected from the group of saturated and unsaturated $C_2$ and $C_3$ hydrocarbons, to form a resulting mixture, the amount of said one or more hydrocarbons being sufficient so that the product of the z factor and the molecular weight of the resulting mixture is lower than the product of the z factor and the molecular weight for natural gas alone at the pressure at which the mixture will be stored, and (b) storing said resulting mixture at a temperature not exceeding 110° F. and a pressure of at least 1000 psia, in the absence of a coherent liquid phase.

2. A method as claimed in claim 1, where the hydrocarbon comprises one or more $C_2$ hydrocarbons, in an amount which depends on the pressure at which the storage takes place, said amount being sufficient to give the mixture a total $C_2$ hydrocarbon content which varies in a continuously decreasing manner from a minimum percentage by volume of not less than 26% when the storage is at a pressure of 1000psia , to a minimum percentage by volume of about 15% when the pressure is 2200 psia.

3. A method as claimed in claim 1, in which the hydrocarbon is ethane.

4. A method as claimed in claim 1, where the hydrocarbon is one or more $C_3$ hydrocarbons in an amount which depends on the pressure at which the storage takes place, said amount being sufficient to give the mixture a total $C_3$ hydrocarbon content which varies in a continuously decreasing manner from a minimum percentage by volume of not less than about 5% when the storage is at a pressure of 1000 psia, to a minimum percentage of about 3% by volume when the pressure is 2200 psia.

5. A method as claimed in claim 1, in which the hydrocarbon is propane or a mixture of propane and ethane.

6. A method of storing or transporting natural gas, which comprises, (a) admixing the natural gas with at least one compound selected from the group of ammonia, carbon monoxide and hydrogen fluoride to form a resulting mixture, and (b) storing said resulting mixture or transmitting it by pipeline at a temperature not exceeding 110° F. and a pressure of at least 800 psia, in the absence of a coherent liquid phase.

7. A method as claimed in claim 6, in which the resulting mixture is stored, and said compound is present in an amount of at least 0.5% by volume, but an amount insufficient to form a liquid phase at the temperature and pressure of storage.

8. A method as claimed in claim 6, in which the resulting mixture is transmitted by pipeline, and said compound is present in an amount of at least 4% by volume, but an amount insufficient to form a liquid phase at the temperature and pressure of such transmission.

9. A method as claimed in claim 7, in which said compound is ammonia.

10. A method as claimed in claim 7, in which said compound is hydrogen fluoride.

11. A method as claimed in claim 7, in which said compound is carbon monoxide.

12. A gas mixture for use in a pipeline or storage at a pressure greater than 800 psia and a temperature of from −40 degrees F., to +100 degrees F. which comprises:

(a) natural gas (b) from 0.5% to 10% by volume of ammonia (c) 0 to 35% by volume of ethane in addition to the ethane forming part of the natural gas, the total being 100%, and such mixture being completely gaseous with no liquid phase at the temperature and pressure of intended operation.

13. A gas mixture as claimed in claim 12, in which the amount of ammonia present is at least 4% by volume.

14. A gas mixture, for use in a pipeline or storage facility at a pressure greater than 1,000 psia and a temperature of −40 degrees F. to +100 degrees F., which comprises:

(a) from 68 to 92% by volume of methane (b) from 6 to 35% by volume of ethane (c) from 0 to 12% by volume of propane (d) from 0 to 1% by volume of butane (e) not more than 1% each of carbon dioxide or nitrogen (f) from 0.5% to 10% of ammonia or hydrogen fluoride the total being 100%, and such mixture being completely gaseous with no liquid phase at the temperature and pressure of intended operation.

15. A gas mixture, for use in a pipeline or storage facility at a pressure greater than 1,000 psia and a temperature of −40 degrees F. to +100 degrees F., which comprises:

(a) from 68 to 92% by volume of methane (b) from 6 to 35% by volume of ethane (c) from 0 to 12% by volume of propane (d) from 0 to 1% by volume of butane (e) not more than 1% each of carbon dioxide or nitrogen (f) at least 1% carbon monoxide the total being 100%, and such mixture being completely gaseous with no liquid phase at the temperature and pressure of intended operation.

16. A method of transporting natural gas which comprises:

adding to said natural gas at least 0. 5% (based on volume of the total mixture) of ammonia to form an ammonia-natural gas mixture which is gaseous at a chosen pressure and temperature of pipeline transport transporting said ammonia-natural gas mixture to a desired destination by a pipeline pressurized to at least 800 psia and at a temperature of between −40° F. and 100° F., and separating said ammonia from said natural gas.

17. A method as claimed in claim 16, in which the amount of ammonia is a least 4% by volume.

* * * * *